US006981553B2

(12) United States Patent
Stegemeier et al.

(10) Patent No.: US 6,981,553 B2
(45) **Date of Patent: *Jan. 3, 2006**

(54) CONTROLLED DOWNHOLE CHEMICAL INJECTION

(75) Inventors: George Leo Stegemeier, Houston, TX (US); Harold J. Vinegar, Houston, TX (US); Robert Rex Burnett, Katy, TX (US); William Mountjoy Savage, Houston, TX (US); Frederick Gordon Carl, Jr., Houston, TX (US); John Michele Hirsch, Houston, TX (US)

(73) Assignee: Shell Oil Company, Houston, TX (US)

( * ) Notice: Subject to any disclaimer, the term of this patent is extended or adjusted under 35 U.S.C. 154(b) by 444 days.

This patent is subject to a terminal disclaimer.

(21) Appl. No.: 10/220,372

(22) PCT Filed: Mar. 2, 2001

(86) PCT No.: PCT/US01/06951

§ 371 (c)(1),
(2), (4) Date: Aug. 30, 2002

(87) PCT Pub. No.: WO01/65055

PCT Pub. Date: Sep. 7, 2001

(65) Prior Publication Data

US 2004/0060703 A1 Apr. 1, 2004

Related U.S. Application Data

(60) Provisional application No. 60/177,999, filed on Jan. 24, 2000, provisional application No. 60/178,000, filed on Jan. 24, 2000, provisional application No. 60/178,001, filed on Jan. 24, 2000, provisional application No. 60/177,883, filed on Jan. 24, 2000, provisional application No. 60/177,998, filed on Jan. 24, 2000, provisional application No. 60/177,997, filed on Jan. 24, 2000, provisional application No. 60/181,322, filed on Feb. 9, 2000, provisional application No. 60/186,376, filed on Mar. 2, 2000, provisional application No. 60/186,380, filed on Mar. 2, 2000, provisional application No. 60/186,505, filed on Mar. 2, 2000, provisional application No. 60/186,504, filed on Mar. 2, 2000, provisional application No. 60/186,379, filed on Mar. 2, 2000, provisional application No. 60/186,394, filed on Mar. 2, 2000, provisional application No. 60/186,382, filed on Mar. 2, 2000, provisional application No. 60/186,503, filed on Mar. 2, 2000, provisional application No. 60/186,527, filed on Mar. 2, 2000, provisional application No. 60/186,393, filed on Mar. 2, 2000, provisional application No. 60/186,394, filed on Mar. 2, 2000, provisional application No. 60/186,531, filed on Mar. 2, 2000, provisional application No. 60/186,377, filed on Mar. 2, 2000, provisional application No. 60/186,381, filed on Mar. 2, 2000, and provisional application No. 60/186,378, filed on Mar. 2, 2000.

(51) Int. Cl.
*E21B 43/00* (2006.01)

(52) U.S. Cl. ..... 166/300; 166/65.1; 166/90.1; 166/305.1

(58) Field of Classification Search ..... 166/300, 166/305.1, 310, 65.1, 72, 73, 90.1
See application file for complete search history.

(56) References Cited

U.S. PATENT DOCUMENTS

| | | | | |
|---|---|---|---|---|
| 525,663 | A | 9/1894 | Mottinger | |
| 2,917,004 | A | 12/1959 | Davis et al. | |
| 3,083,771 | A | 4/1963 | Chapman | |
| 3,247,904 | A | 4/1966 | Wakefield, Jr. | |
| 3,427,989 | A | 2/1969 | Bostock et al. | |
| 3,566,963 | A | 3/1971 | Blackledge | 166/189 |
| 3,602,305 | A | 8/1971 | Kisling, III | 116/134 |
| 3,732,728 | A | 5/1973 | Fitzpatrick | 73/151 |
| 3,793,632 | A | 2/1974 | Still | 340/18 |
| 3,814,545 | A | 6/1974 | Waters | 417/90 |
| 3,837,618 | A | 9/1974 | Juhel | 251/129 |
| 3,980,826 | A | 9/1976 | Widmer | 178/68 |
| 4,068,717 | A | 1/1978 | Needham | |
| 4,087,781 | A | 5/1978 | Grossi et al. | 340/18 |
| 4,295,795 | A | 10/1981 | Gass et al. | 417/111 |
| 4,393,485 | A | 7/1983 | Redden | 367/25 |
| 4,468,665 | A | 8/1984 | Thawley et al. | 340/856 |
| 4,545,731 | A | 10/1985 | Canalizo et al. | 417/66 |
| 4,576,231 | A | 3/1986 | Dowling et al. | 166/248 |
| 4,578,675 | A | 3/1986 | MacLeod | 340/855 |
| 4,596,516 | A | 6/1986 | Scott et al. | 417/58 |
| 4,630,243 | A | 12/1986 | MacLeod | 367/82 |
| 4,648,471 | A | 3/1987 | Bordon | 175/4.55 |

| | | | | |
|---|---|---|---|---|
| 4,662,437 | A | 5/1987 | Renfro | |
| 4,681,164 | A | 7/1987 | Stacks | |
| 4,709,234 | A | 11/1987 | Forehand et al. | 340/856 |
| 4,738,313 | A | 4/1988 | McKee | 166/372 |
| 4,739,325 | A | 4/1988 | MacLeod | 340/854 |
| 4,839,644 | A | 6/1989 | Safinya et al. | 340/854 |
| 4,886,114 | A | 12/1989 | Perkins et al. | 166/65.1 |
| 4,901,069 | A | 2/1990 | Veneruso | 340/853 |
| 4,972,704 | A | 11/1990 | Wellington et al. | 73/155 |
| 4,981,173 | A | 1/1991 | Perkins et al. | 166/66.4 |
| 5,001,675 | A | 3/1991 | Woodward | 367/13 |
| 5,008,664 | A | 4/1991 | More et al. | |
| 5,130,706 | A | 7/1992 | Van Steenwyk | 340/854.6 |
| 5,134,285 | A | 7/1992 | Perry et al. | 250/269 |
| 5,160,925 | A | 11/1992 | Dailey et al. | 340/853.3 |
| 5,162,740 | A | 11/1992 | Jewell | 324/347 |
| 5,172,717 | A | 12/1992 | Boyle et al. | 137/155 |
| 5,176,164 | A | 1/1993 | Boyle | 137/155 |
| 5,191,326 | A | 3/1993 | Montgomery | 340/855.5 |
| 5,230,383 | A | 7/1993 | Pringle et al. | 166/66.4 |
| 5,246,860 | A | 9/1993 | Hutchins et al. | |
| 5,251,328 | A | 10/1993 | Shaw | 455/73 |
| 5,257,663 | A | 11/1993 | Pringle et al. | 166/66.4 |
| 5,267,469 | A | 12/1993 | Espinoza | 73/40.5 |
| 5,278,758 | A | 1/1994 | Perry et al. | 364/422 |
| 5,331,318 | A | 7/1994 | Montgomery | 340/855.4 |
| 5,353,627 | A | 10/1994 | Diatschenko et al. | 73/19.03 |
| 5,358,035 | A | 10/1994 | Grudzinski | 166/53 |
| 5,367,694 | A | 11/1994 | Ueno | 395/800 |
| 5,394,141 | A | 2/1995 | Soulier | 340/854.4 |
| 5,396,232 | A | 3/1995 | Mathieu et al. | 340/854.5 |
| 5,425,425 | A | 6/1995 | Bankston | 166/377 |
| 5,447,201 | A | 9/1995 | Mohn | 166/375 |
| 5,458,200 | A | 10/1995 | Lagerlef et al. | 166/372 |
| 5,467,083 | A | 11/1995 | McDonald et al. | 340/854.6 |
| 5,473,321 | A | 12/1995 | Goodman et al. | 340/854.9 |
| 5,493,288 | A | 2/1996 | Henneuse | 340/854.4 |
| 5,531,270 | A | 7/1996 | Fletcher et al. | 166/53 |
| 5,561,245 | A | 10/1996 | Georgi et al. | 73/152.02 |
| 5,574,374 | A | 11/1996 | Thompson et al. | 324/338 |
| 5,576,703 | A | 11/1996 | MacLeod et al. | 340/854.4 |
| 5,587,707 | A | 12/1996 | Dickie et al. | 340/870.09 |
| 5,592,438 | A | 1/1997 | Rorden et al. | 367/83 |
| 5,662,165 | A | 9/1997 | Tubel et al. | 166/250.01 |
| 5,723,781 | A | 3/1998 | Pruett et al. | 73/152.18 |
| 5,730,219 | A | 3/1998 | Tubel et al. | 66/250.01 |
| 5,745,047 | A | 4/1998 | Van Gisbergen et al. | 340/853.1 |
| 5,782,261 | A | 7/1998 | Becker et al. | 137/155 |
| 5,797,453 | A | 8/1998 | Hisaw | 166/117.5 |
| 5,881,807 | A | 3/1999 | Boe et al. | |
| 5,883,516 | A | 3/1999 | Van Steenwyk et al. | 324/366 |
| 5,887,657 | A | 3/1999 | Bussear et al. | 166/336 |
| 5,896,924 | A | 4/1999 | Carmody et al. | 166/53 |
| 5,934,371 | A | 8/1999 | Bussear et al. | 166/53 |
| 5,937,945 | A | 8/1999 | Bussear et al. | 166/250.15 |
| 5,941,307 | A | 8/1999 | Tubel | 166/313 |
| 5,955,666 | A | 9/1999 | Mullins | 73/152.18 |
| 5,959,499 | A | 9/1999 | Khan et al. | 330/149 |
| 5,960,883 | A | 10/1999 | Tubel et al. | 166/313 |
| 5,963,090 | A | 10/1999 | Fukuchi | 330/149 |
| 5,971,072 | A | 10/1999 | Huber et al. | 166/297 |
| 5,975,204 | A | 11/1999 | Tubel et al. | 166/250.15 |
| 5,995,020 | A | 11/1999 | Owens et al. | 340/854.9 |
| 6,012,015 | A | 1/2000 | Tubel | 702/6 |
| 6,012,016 | A | 1/2000 | Bilden et al. | 702/12 |
| 6,070,608 | A | 6/2000 | Pringle | 137/155 |
| 6,123,148 | A | 9/2000 | Oneal | 166/118 |
| 6,148,915 | A | 11/2000 | Mullen et al. | 166/278 |
| 6,192,983 | B1 | 2/2001 | Neuroth et al. | 166/250.15 |
| 6,208,586 | B1 | 3/2001 | Rorden et al. | 367/35 |
| 6,334,486 | B1 | 1/2002 | Carmody et al. | 166/53 |
| 6,484,800 | B2 | 11/2002 | Carmody et al. | 166/53 |
| 6,633,164 | B2 * | 10/2003 | Vinegar et al. | 324/355 |
| 6,633,236 | B2 * | 10/2003 | Vinegar et al. | 340/854.4 |
| 6,662,875 | B2 * | 12/2003 | Bass et al. | 166/369 |
| 2003/0056952 | A1 * | 3/2003 | Stegemeier et al. | 166/250.12 |
| 2003/0066652 | A1 * | 4/2003 | Stegemeier et al. | 166/373 |

FOREIGN PATENT DOCUMENTS

| | | | |
|---|---|---|---|
| EP | 28296 | | 5/1981 |
| EP | 295178 | | 12/1988 |
| EP | 339825 | A1 | 4/1989 |
| EP | 492856 | A2 | 7/1992 |
| EP | 641916 | | 3/1995 |
| EP | 681090 | A2 | 11/1995 |
| EP | 697500 | | 2/1996 |
| EP | 0 721 053 | A1 | 7/1996 |
| EP | 732053 | | 9/1996 |
| EP | 919696 | A2 | 6/1999 |
| EP | 922835 | A2 | 6/1999 |
| EP | 930518 | A2 | 7/1999 |
| EP | 964134 | A2 | 12/1999 |
| EP | 972909 | A2 | 1/2000 |
| EP | 999341 | A2 | 5/2000 |
| FR | 2677134 | | 12/1992 |
| GB | 2083321 | A | 3/1982 |
| GB | 2325949 | A | 12/1998 |
| GB | 2327695 | A | 2/1999 |
| GB | 2338253 | A | 12/1999 |
| WO | 80/00727 | | 4/1980 |
| WO | 93/26115 | | 12/1993 |
| WO | 96/00836 | | 1/1996 |
| WO | 96/24747 | | 8/1996 |
| WO | 97/16751 | | 5/1997 |
| WO | 97 37103 | | 10/1997 |
| WO | 98/20233 | | 5/1998 |
| WO | 99/37044 | | 7/1999 |
| WO | 99/57417 | | 11/1999 |
| WO | 99/60247 | | 11/1999 |
| WO | 00/04275 | | 1/2000 |
| WO | 00 37770 | | 6/2000 |
| WO | 01/20126 | A2 | 3/2001 |
| WO | 01/55555 | A1 | 8/2001 |

OTHER PUBLICATIONS

Brown.Connolizo and Robertson, West Texas Oil Lifting Short Course and H.W. Winkler, "Misunderstood or overlooked Gas–Lift Design and Equipment Considerations," SPE, p. 351 (1994).

Der Spek, Alex, and Aliz Thomas, "Neural–Net Identification of Flow Regime with Band Spectra of Flow–Generated Sound", SPE Reservoir Eva. & Eng.2 (6) Dec. 1999, pp. 489–498.

Sakata et al., "Performance Analysis of Long Distance Transmitting of Magnetic Signal on Cylindrical Steel Rod", IEEE Translation Journal on magnetics in Japan, vol. 8, No. 2. Feb. 1993,, pps. 102–106.

Otis Engineering, Aug. 1980, "Heavy Crude Lift System", Field Development Report, OEC 5228, Otis Corp., Dallas, Texas.

* cited by examiner

*Primary Examiner*—William Neuder

(57) ABSTRACT

A petroleum well having a well casing, a production tubing, a source of time-varying current, a downhole chemical injection device, and a downhole induction choke. The casing extends within a wellbore of the well. The tubing extends within the casing. The current source is located at the surface. The current source is electrically connected to, and adapted to output a time-varying current into, the tubing and/or the casing, which act as electrical conductors for providing downhole power and/or communications. The injection device having a communications and control module, a chemical container, and an electrically controllable chemical injector. The communications and control module is electrically connected to the tubing and/or the casing. The chemical injector is electrically connected to the communications and control module, and is in fluid communication with the chemical container. The downhole induction choke is located about a portion of the tubing and/or the casing. The chemical injector is electrically connected to the communications and control module, and is in fluid communication with the chemical container. The downhole induction choke is located about a portion of the tubing and/or the casing. The induction choke is adapted to route part of the electrical current through the communications and control module by creating a voltage potential between one side of the induction choke and another side of the induction choke. The communications and control module is electrically connected across the voltage potential. Also, a method is provided for controllably injecting a chemical into the well downhole, which may be used to: improve lift efficiency with a foaming agent, prevent deposition of solids with a paraffin solvent, improve a flow characteristic of the flow stream with a surfactant, prevent corrosion with a corrosion inhibitor, and/or prevent scaling with scale preventers.

41 Claims, 5 Drawing Sheets

CONTROLLED DOWNHOLE CHEMICAL INJECTION

CROSS-REFERENCES TO RELATED APPLICATIONS

This application claims the benefit of the following U.S. Provisional Applications, all of which are hereby incorporated by reference:

COMMONLY OWNED AND PREVIOUSLY FILED U.S. PROVISIONAL PATENT APPLICATIONS

| T & K # | Serial Number | Title | Filing Date |
|---|---|---|---|
| TH 1599 | 60/177,999 | Toroidal Choke Inductor for Wireless Communication and Control | Jan. 24, 2000 |
| TH 1600 | 60/178,000 | Ferromagnetic Choke in Wellhead | Jan. 24, 2000 |
| TH 1602 | 60/178,001 | Controllable Gas-Lift Well and Valve | Jan. 24, 2000 |
| TH 1603 | 60/177,883 | Permanent, Downhole, Wireless, Two-Way Telemetry Backbone Using Redundant Repeater, Spread Spectrum Arrays | Jan. 24, 2000 |
| TH 1668 | 60/177,998 | Petroleum Well Having Downhole Sensors, Communication, and Power | Jan. 24, 2000 |
| TH 1669 | 60/177,997 | System and Method for Fluid Flow Optimization | Jan. 24, 2000 |
| TS 6185 | 60/181,322 | A Method and Apparatus for the Optimal Predistortion of an Electromagnetic Signal in a Downhole Communications System | Feb. 9, 2000 |
| TH 1599x | 60/186,376 | Toroidal Choke Inductor for Wireless Communication and Control | Mar. 2, 2000 |
| TH 1600x | 60/186,380 | Ferromagnetic Choke in Wellhead | Mar. 2, 2000 |
| TH 1601 | 60/186,505 | Reservoir Production Control from Intelligent Well Data | Mar. 2, 2000 |
| TH 1671 | 60/186,504 | Tracer Injection in a Production Well | Mar. 2, 2000 |
| TH 1672 | 60/186,379 | Oilwell Casing Electrical Power Pick-Off Points | Mar. 2, 2000 |
| TH 1673 | 60/186,394 | Controllable Production Well Packer | Mar. 2, 2000 |
| TH 1674 | 60/186,382 | Use of Downhole High Pressure Gas in a Gas Lift Well | Mar. 2, 2000 |
| TH 1675 | 60/186,503 | Wireless Smart Well Casing | Mar. 2, 2000 |
| TH 1677 | 60/186,527 | Method for Downhole Power Management Using Energization from Distributed Batteries or Capacitors with Reconfigurable Discharge | Mar. 2, 2000 |
| TH 1679 | 60/186,393 | Wireless Downhole Well Interval Inflow and Injection Control | Mar. 2, 2000 |
| TH 1681 | 60/186,394 | Focused Through-Casing Resistivity Measurement | Mar. 2, 2000 |
| TH 1704 | 60/186,531 | Downhole Rotary Hydraulic Pressure for Valve Actuation | Mar. 2, 2000 |
| TH 1705 | 60/186,377 | Wireless Downhole Measurement and Control For Optimizing Gas Lift Well and Field Performance | Mar. 2, 2000 |
| TH 1722 | 60/186,381 | Controlled Downhole Chemical Injection | Mar. 2, 2000 |
| TH 1723 | 60/186,378 | Wireless Power and Communications Cross-Bar Switch | Mar. 2, 2000 |

The current application shares some specification and figures with the following commonly owned and concurrently filed applications, all of which are hereby incorporated by reference:

COMMONLY OWNED AND CONCURRENTLY FILED U.S. PATENT APPLICATIONS

| T & K # | Serial Number | Title | Filing Date |
|---|---|---|---|
| TH 1601US | 10/220,254 | Reservoir Production Control from Intelligent Well Data | Aug. 29, 2002 |
| TH 1671US | 10/220,251 | Tracer Injection in a Production Well | Aug. 29, 2002 |
| TH 1672US | 10/220,402 | Oilwell Casing Electrical Power Pick-Off Points | Aug. 29, 2002 |

-continued

COMMONLY OWNED AND CONCURRENTLY FILED U.S. PATENT APPLICATIONS

| T & K # | Serial Number | Title | Filing Date |
|---|---|---|---|
| TH 1673US | 10/220,252 | Controllable Production Well Packer | Aug. 29, 2002 |
| TH 1674US | 10/220,249 | Use of Downhole High Pressure Gas in a Gas-Lift Well | Aug. 29, 2002 |
| TH 1675US | 10/220,195 | Wireless Smart Well Casing | Aug. 29, 2002 |
| TH 1677US | 10/220,253 | Method for Downhole Power Management Using Energization from Distributed Batteries or Capacitors with Reconfigurable Discharge | Aug. 29, 2002 |

-continued

| COMMONLY OWNED AND CONCURRENTLY FILED U.S. PATENT APPLICATIONS | | | |
|---|---|---|---|
| T & K # | Serial Number | Title | Filing Date |
| TH 1679US | 10/220,453 | Wireless Downhole Well Interval Inflow and Injection Control | Aug. 29, 2002 |
| TH 1704US | 10/220,326 | Downhole Rorary Hydraulic Pressure for Valve Actuation | Aug. 29, 2002 |
| TH 1705US | 10/220,455 | Wireless Downhole Measurement and Control For Optimizing Gas Lift Well and Field Performance | Aug. 29, 2002 |
| TH 1723US | 10/220,652 | Wireless Power and Communications Cross-Bar Switch | Aug. 29, 2002 |

The current application shares some specification and figures with the following commonly owned and previously filed applications, all of which are hereby incorporated by reference:

| COMMONLY OWNED AND PREVIOUSLY FILED U.S. PATENT APPLICATIONS | | | |
|---|---|---|---|
| T & K # | Serial Number | Title | Filing Date |
| TH 1599US | 09/769,047 | Toroidal Choke Inductor for Wireless Communication and Control | Oct. 20, 2003 |
| TH 1600US | 09/769,048 | Induction Choke for Power Distribution in Piping Structure | Jan. 24, 2001 |
| TH 1602US | 09/768,705 | Controllable Gas-Lift Well and Valve | Jan. 24, 2001 |
| TH 1603US | 09/768,655 | Permanent Downhole, Wireless, Two-Way | Jan. 24, 2001 |
| | | Telemetry Backbone Using Redundant Repeater | Jan. 24, 2001 |
| TH 1668US | 09/768,046 | Petroleum Well Having Downhole Sensors, Communication, and Power | Jan. 24, 2001 |
| TH 1669US | 09/768,656 | System and Method for Fluid Flow Optimization | Jan. 24, 2001 |
| TS 6185US | 09/779,935 | A Method and Apparatus for the Optimal Predistortion of an Electro Magnetic Signal in a Downhole Communications System | Feb. 8, 2001 |

The benefit of 35 U.S.C. §120 is claimed for all of the above referenced commonly owned applications. The applications referenced in the tables above are referred to herein as the "Related Applications."

BACKGROUND OF THE INVENTION

1. Field of the Invention

The present invention relates to a petroleum well for producing petroleum products. In one aspect, the present invention relates to systems and methods for monitoring and/or improving fluid flow during petroleum production by controllably injecting chemicals into at least one fluid flow stream with at least one electrically controllable downhole chemical injection system of a petroleum well.

2. Description of Related Art

The controlled injection of materials into petroleum wells (i.e., oil and gas wells) is an established practice frequently used to increase recovery, or to analyze production conditions.

It is useful to distinguish between types of injection, depending on the quantities of materials that will be injected. Large volumes of injected materials are injected into formations to displace formation fluids towards producing wells. The most common example is water flooding.

In a less extreme case, materials are introduced downhole into a well to effect treatment within the well. Examples of these treatments include: (1) foaming agents to improve the efficiency of artificial lift; (2) paraffin solvents to prevent deposition of solids onto the tubing; and (3) surfactants to improve the flow characteristics of produced fluids. These types of treatment entail modification of the well fluids themselves. Smaller quantities are needed, yet these types of injection are typically supplied by additional tubing routed downhole from the surface.

Still other applications require even smaller quantities of materials to be injected, such as: (1) corrosion inhibitors to prevent or reduce corrosion of well equipment; (2) scale preventers to prevent or reduce scaling of well equipment; and (3) tracer chemicals to monitor the flow characteristics of various well sections. In these cases the quantities required are small enough that the materials may be supplied from a downhole reservoir, avoiding the need to run supply tubing downhole from the surface. However, successful application of such techniques requires controlled injection.

The controlled injection of materials such as water, foaming agents, paraffin solvents, surfactants, corrosion inhibitors, scale preventers, and tracer chemicals to monitor flow characteristics are documented in U.S. Pat. Nos. 4,681,164, 5,246,860, and 4, 068,717.

All references cited herein are incorporated by reference to the maximum extent allowable by law. To the extent a reference may not be fully incorporated herein, it is incorporated by reference for background purposes, and indicative of the knowledge of one of ordinary skill in the art.

BRIEF SUMMARY OF THE INVENTION

The problems and needs outlined above are largely solved and met by the present invention. In accordance with one aspect of the present invention, a chemical injection system for use in a well, is provided. The chemical injection system comprises a current impedance device and an electrically controllable chemical injection device. The current impedance device is generally configured for concentric positioning about a portion of a piping structure of the well. When a time-varying electrical current is transmitted through and along the portion of the piping structure, a voltage potential forms between one side of the current impedance device and another side of the current impedance device. The electrically controllable chemical injection device is adapted to be electrically connected to the piping structure across the voltage potential formed by the current impedance device, adapted to be powered by said electrical current, and adapted to expel a chemical into the well in response to an electrical signal.

In accordance with another aspect of the present invention, a petroleum well for producing petroleum products, is provided. The petroleum well comprises a piping structure, a source of time-varying current, an induction choke, an electrically controllable chemical injection device, and an electrical return. The piping structure comprises a first portion, a second portion, and an electrically conductive portion extending in and between the first and second portions. The first and second portions are distally spaced from each other along the piping structure. The source of time-varying current is electrically connected to the electrically conductive portion of the piping structure at the first portion. The induction choke is located about a portion of the electrically conductive portion of the piping structure at the second portion. The electrically controllable chemical injection device comprises two device terminals, and is located at the second portion. The electrical return electrically connects between the electrically conductive portion of the piping structure at the second portion and the current source. The first of the device terminals is electrically connected to the electrically conductive portion of the piping structure on a source-side of the induction choke. The second of the device terminals is electrically connected to the electrically conductive portion of the piping structure on an electrical-return-side of the induction choke and/or the electrical return.

In accordance with yet another aspect of the present invention, a petroleum well for producing petroleum products, is provided. The petroleum well comprises a well casing, a production tubing, a source of time-varying current, a downhole chemical injection device, and a downhole induction choke. The well casing extends within a wellbore of the well. The production tubing extends within the casing. The source of time-varying current is located at the surface. The current source is electrically connected to, and adapted to output a time-varying current into, the tubing and/or the casing, which act as electrical conductors to a downhole location. The downhole chemical injection device comprises a communications and control module, a chemical container, and an electrically controllable chemical injector. The communications and control module is electrically connected to the tubing and/or the casing. The chemical injector is electrically connected to the communications and control module, and is in fluid communication with the chemical container. The downhole induction choke is located about a portion of the tubing and/or the casing. The induction choke is adapted to route part of the electrical current through the communications and control module by creating a voltage potential between one side of the induction choke and another side of the induction choke. The communications and control module is electrically connected across the voltage potential.

In accordance with still another aspect of the present invention, a method of producing petroleum products from a petroleum well, is provided. The method comprises the steps of: (i) providing a well casing extending within a wellbore of the well and a production tubing extending within the casing, wherein the casing is electrically connected to the tubing at a downhole location; (ii) providing a downhole chemical injection system for the well comprising an induction choke and an electrically controllable chemical injection device, the induction choke being located downhole about the tubing and/or the casing such that when a time-varying electrical current is transmitted through the tubing and/or the casing, a voltage potential forms between one side of the induction choke and another side of the induction choke, the electrically controllable chemical injection device being located downhole, the injection device being electrically connected to the tubing and/or the casing across the voltage potential formed by the induction choke such that the injection device can be powered by the electrical current, and the injection device being adapted to expel a chemical in response to an electrical signal carried by the electrical current; and (iii) controllably injecting a chemical into a downhole flow stream within the well during production. If the well is a gas-lift well and the chemical comprises a foaming agent, the method may further comprise the step of improving an efficiency of artificial lift of the petroleum productions with the foaming agent. If the chemical comprises a paraffin solvent, the method may further comprise the step of preventing deposition of solids on an interior of the tubing. If the chemical comprises a surfactant, the method may further comprise the step of improving a flow characteristic of the flow stream. If the chemical comprises a corrosion inhibitor, the method may further comprise the step of inhibiting corrosion in said well. If the chemical comprises scale preventers, the method may further comprise the step of reducing scaling in said well.

BRIEF DESCRIPTION OF THE DRAWINGS

Other objects and advantages of the invention will become apparent upon reading the following detailed description and upon referencing the accompanying drawings, in which.

DETAILED DESCRIPTION OF THE INVENTION

Figure 1:
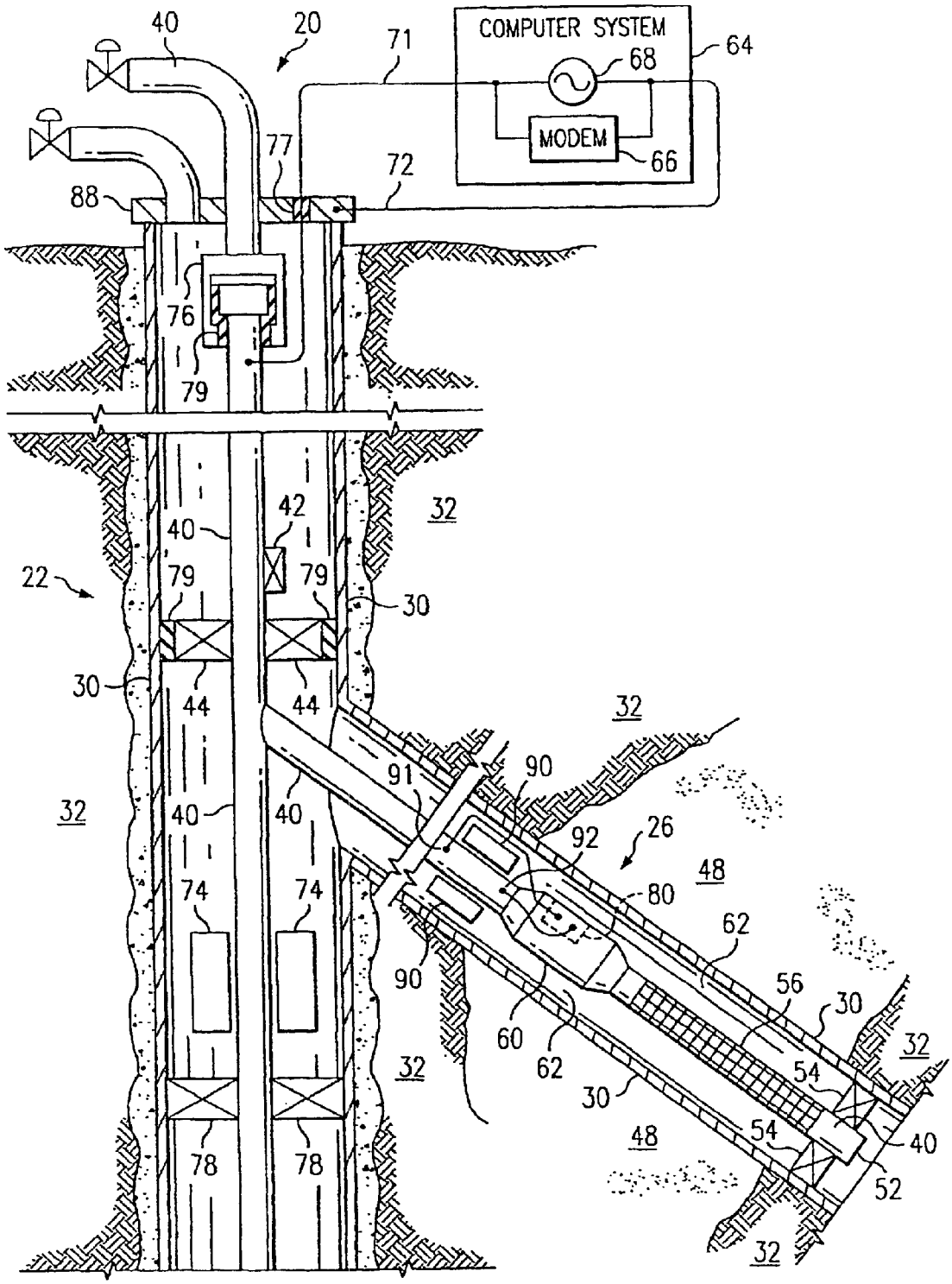
FIG. 1 is a schematic showing a petroleum production well in accordance with a preferred embodiment of the present invention.

Referring now to the drawings, wherein like reference numbers are used herein to designate like elements throughout the various views, a preferred embodiment of the present invention is illustrated and further described, and other possible embodiments of the present invention are described. The figures are not necessarily drawn to scale, and in some instances the drawings have been exaggerated and/or simplified in places for illustrative purposes only. One of ordinary skill in the art will appreciate the many possible applications and variations of the present invention based on the following examples of possible embodiments of the present invention, as well as based on those embodiments illustrated and discussed in the Related Applications, which are incorporated by reference herein to the maximum extent allowed by law.

As used in the present application, a "piping structure" can be one single pipe, a tubing string, a well casing, a pumping rod, a series of interconnected pipes, rods, rails, trusses, lattices, supports, a branch or lateral extension of a well, a network of interconnected pipes, or other similar structures known to one of ordinary skill in the art. A preferred embodiment makes use of the invention in the context of a petroleum well where the piping structure comprises tubular, metallic, electrically-conductive pipe or tubing strings, but the invention is not so limited. For the present invention, at least a portion of the piping structure needs to be electrically conductive, such electrically conductive portion may be the entire piping structure (e.g., steel pipes, copper pipes) or a longitudinal extending electrically conductive portion combined with a longitudinally extending non-conductive portion. In other words, an electrically conductive piping structure is one that provides an electrical conducting path from a first portion where a power source is electrically connected to a second portion where a device and/or electrical return is electrically connected. The piping structure will typically be conventional round metal tubing, but the cross-section geometry of the piping structure, or any portion thereof, can vary in shape (e.g., round, rectangular, square, oval) and size (e.g., length, diameter, wall thickness) along any portion of the piping structure. Hence, a piping structure must have an electrically conductive portion extending from a first portion of the piping structure to a second portion of the piping structure, wherein the first portion is distally spaced from the second portion along the piping structure.

The terms "first portion" and "second portion" as used herein are each defined generally to call out a portion, section, or region of a piping structure that may or may not extend along the piping structure, that can be located at any chosen place along the piping structure, and that may or may not encompass the most proximate ends of the piping structure.

The term "modem" is used herein to generically refer to any communications device for transmitting and/or receiving electrical communication signals via an electrical conductor (e.g., metal). Hence, the term "modem" as used herein is not limited to the acronym for a modulator (device that converts a voice or data signal into a form that can be transmitted)/demodulator (a device that recovers an original signal after it has modulated a high frequency carrier). Also, the term "modem" as used herein is not limited to conventional computer modems that convert digital signals to analog signals and vice versa (e.g., to send digital data signals over the analog Public Switched Telephone Network). For example, if a sensor outputs measurements in an analog format, then such measurements may only need to be modulated (e.g., spread spectrum modulation) and transmitted—hence no analog/digital conversion needed. As another example, a relay/slave modem or communication device may only need to identify, filter, amplify, and/or retransmit a signal received.

The term "valve" as used herein generally refers to any device that functions to regulate the flow of a fluid. Examples of valves include, but are not limited to, bellows-type gas-lift valves and controllable gas-lift valves, each of which may be used to regulate the flow of lift gas into a tubing string of a well. The internal and/or external workings of valves can vary greatly, and in the present application, it is not intended to limit the valves described to any particular configuration, so long as the valve functions to regulate flow. Some of the various types of flow regulating mechanisms include, but are not limited to, ball valve configurations, needle valve configurations, gate valve configurations, and cage valve configurations. The methods of installation for valves discussed in the present application can vary widely.

The term "electrically controllable valve" as used herein generally refers to a "valve" (as just described) that can be opened, closed, adjusted, altered, or throttled continuously in response to an electrical control signal (e.g., signal from a surface computer or from a downhole electronic controller module). The mechanism that actually moves the valve position can comprise, but is not limited to: an electric motor; an electric servo; an electric solenoid; an electric switch; a hydraulic actuator controlled by at least one electrical servo, electrical motor, electrical switch, electric solenoid, or combinations thereof; a pneumatic actuator controlled by at least one electrical servo, electrical motor, electrical switch, electric solenoid, or combinations thereof; or a spring biased device in combination with at least one electrical servo, electrical motor, electrical switch, electric solenoid, or combinations thereof. An "electrically controllable valve" may or may not include a position feedback sensor for providing a feedback signal corresponding to the actual position of the valve.

The term "sensor" as used herein refers to any device that detects, determines, monitors, records, or otherwise senses the absolute value of or a change in a physical quantity. A sensor as described herein can be used to measure physical quantities including, but not limited to: temperature, pressure (both absolute and differential), flow rate, seismic data, acoustic data, pH level, salinity levels, valve positions, or almost any other physical data.

As used in the present application, "wireless" means the absence of a conventional, insulated wire conductor e.g. extending from a downhole device to the surface. Using the tubing and/or casing as a conductor is considered "wireless."

The phrase "at the surface" as used herein refers to a location that is above about fifty feet deep within the Earth. In other words, the phrase "at the surface" does not necessarily mean sitting on the ground at ground level, but is used more broadly herein to refer to a location that is often easily or conveniently accessible at a wellhead where people may be working. For example, "at the surface" can be on a table in a work shed that is located on the ground at the well platform, it can be on an ocean floor or a lake floor, it can be on a deep-sea oil rig platform, or it can be on the 100th floor of a building. Also, the term "surface" may be used herein as an adjective to designate a location of a component or region that is located "at the surface." For example, as used herein, a "surface" computer would be a computer located "at the surface."

The term "downhole" as used herein refers to a location or position below about fifty feet deep within the Earth. In other words, "downhole" is used broadly herein to refer to a location that is often not easily or conveniently accessible from a wellhead where people may be working. For example in a petroleum well, a "downhole" location is often at or proximate to a subsurface petroleum production zone, irrespective of whether the production zone is accessed vertically, horizontally, lateral, or any other angle therebetween. Also, the term "downhole" is used herein as an adjective describing the location of a component or region. For example, a "downhole" device in a well would be a device located "downhole," as opposed to being located "at the surface."

Similarly, in accordance with conventional terminology of oilfield practice, the descriptors "upper," "lower," "uphole," and "downhole" are relative and refer to distance along hole depth from the surface, which in deviated or horizontal wells may or may not accord with vertical elevation measured with respect to a survey datum.

FIG. 1 is a schematic showing a petroleum production well 20 in accordance with a preferred embodiment of the present invention. The well 20 has a vertical section 22 and a lateral section 26. The well has a well casing 30 extending within wellbores and through a formation 32, and a production tubing 40 extends within the well casing for conveying fluids from downhole to the surface during production. Hence, the petroleum production well 20 shown in FIG. 1 is similar to a conventional well in construction, but with the incorporation of the present invention.

The vertical section 22 in this embodiment incorporates a gas-lift valve 42 and an upper packer 44 to provide artificial lift for fluids within the tubing 40. However, in alternative, other ways of providing artificial lift may be incorporated to form other possible embodiments (e.g., rod pumping). Also, the vertical portion 22 can further vary to form many other possible embodiments. For example in an enhanced form, the vertical portion 22 may incorporate one or more electrically controllable gas-lift valves, one or more additional induction chokes, and/or one or more controllable packers comprising electrically controllable packer valves, as further described in the Related Applications.

The lateral section 26 of the well 20 extends through a petroleum production zone 48 (e.g., oil zone) of the formation 32. The casing 30 in the lateral section 26 is perforated to allow fluids from the production zone 48 to flow into the casing. FIG. 1 shows only one lateral section 26, but there can be many lateral branches of the well 20. The well configuration typically depends, at least in part, on the layout of the production zones for a given formation.

Part of the tubing 40 extends into the lateral section 26 and terminates with a closed end 52 past the production zone 48. The position of the tubing end 52 within the casing 30 is maintained by a lateral packer 54, which is a conventional packer. The tubing 40 has a perforated section 56 for fluid intake from the production zone 48. In other embodiments (not shown), the tubing 40 may continue beyond the production zone 48 (e.g., to other production zones), or the tubing 40 may terminate with an open end for fluid intake. An electrically controllable downhole chemical injection device 60 is connected inline on the tubing 40 within the lateral section 26 upstream of the production zone 48 and forms part of the production tubing assembly. In alternative, the injection device 60 may be placed further upstream within the lateral section 26. An advantage of placing the injection device 60 proximate to the tubing intake 56 at the production zone 48 is that it a desirable location for injecting a tracer (to monitor the flow into the tubing at this production zone) or for injecting a foaming agent (to enhance gas-lift performance). In other possible embodiments, the injection device 60 may be adapted to controllably inject a chemical or material at a location outside of the tubing 40 (e.g., directly into the producing zone 48, or into an annular space 62 within the casing 30). Also, an electrically controllable downhole chemical injection device 60 may be placed in any downhole location within a well where it is needed.

An electrical circuit is formed using various components of the well 20. Power for the electrical components of the injection device 60 is provided from the surface using the tubing 40 and casing 30 as electrical conductors. Hence, in a preferred embodiment, the tubing 40 acts as a piping structure and the casing 30 acts as an electrical return to form an electrical circuit in the well 20. Also, the tubing 40 and casing 30 are used as electrical conductors for communication signals between the surface (e.g., a surface computer system) and the downhole electrical components within the electrically controllable downhole chemical injection device 60.

In FIG. 1, a surface computer system 64 comprises a master modem 66 and a source of time-varying current 68. But, as will be clear to one of ordinary skill in the art, the surface equipment can vary. A first computer terminal 71 of the surface computer system 64 is electrically connected to the tubing 40 at the surface, and imparts time-varying electrical current into the tubing 40 when power to and/or communications with the downhole devices is needed. The current source 68 provides the electrical current, which carries power and communication signals downhole. The time-varying electrical current is preferably alternating current (AC), but it can also be a varying direct current (DC). The communication signals can be generated by the master modem 66 and embedded within the current produced by the source 68. Preferably, the communication signal is a spread spectrum signal, but other forms of modulation or predistortion can be used in alternative.

A first induction choke 74 is located about the tubing in the vertical section 22 below the location where the lateral section 26 extends from the vertical section. A second induction choke 90 is located about the tubing 40 within the lateral section 26 proximate to the injection device 60. The induction chokes 74, 90 comprise a ferromagnetic material and are unpowered. Because the chokes 74, 90 are located about the tubing 40, each choke acts as a large inductor to AC in the well circuit formed by the tubing 40 and casing 30. As described in detail in the Related Applications, the chokes 74, 90 function based on their size (mass), geometry, and magnetic properties.

An insulated tubing joint 76 is incorporated at the wellhead to electrically insulate the tubing 40 from casing 30. The first computer terminal 71 from the current source 68 passes through an insulated seal 77 at the hanger 88 and electrically connects to the tubing 40 below the insulated tubing joint 76. A second computer terminal 72 of the surface computer system 64 is electrically connected to the casing 30 at the surface. Thus, the insulators 79 of the tubing joint 76 prevent an electrical short circuit between the tubing 40 and casing 30 at the surface. In alternative to or in addition to the insulated tubing joint 76, a third induction choke (not shown) can be placed about the tubing 40 above the electrical connection location for the first computer terminal 71 to the tubing, and/or the hanger 88 may be an insulated hanger (not shown) having insulators to electrically insulate the tubing 40 from the casing 30.

The lateral packer 54 at the tubing end 52 within the lateral section 26 provides an electrical connection between the tubing 40 and the casing 30 downhole beyond the second choke 90. A lower packer 78 in the vertical section 22, which is also a conventional packer, provides an electrical connection between the tubing 40 and the casing 30 downhole below the first induction choke 74. The upper packer 44 of the vertical section 22 has an electrical insulator 79 to prevent an electrical short circuit between the tubing 40 and the casing 30 at the upper packer. Also, various centralizers (not shown) having electrical insulators to prevent shorts between the tubing 40 and casing 30 can be incorporated as needed throughout the well 20. Such electrical insulation of the upper packer 44 or a centralizer may be achieved in various ways apparent to one of ordinary skill in the art. The upper and lower packers 44, 78 provide hydraulic isolation between the main wellbore of the vertical section 22 and the lateral wellbore of the lateral section 26.

Figure 2:
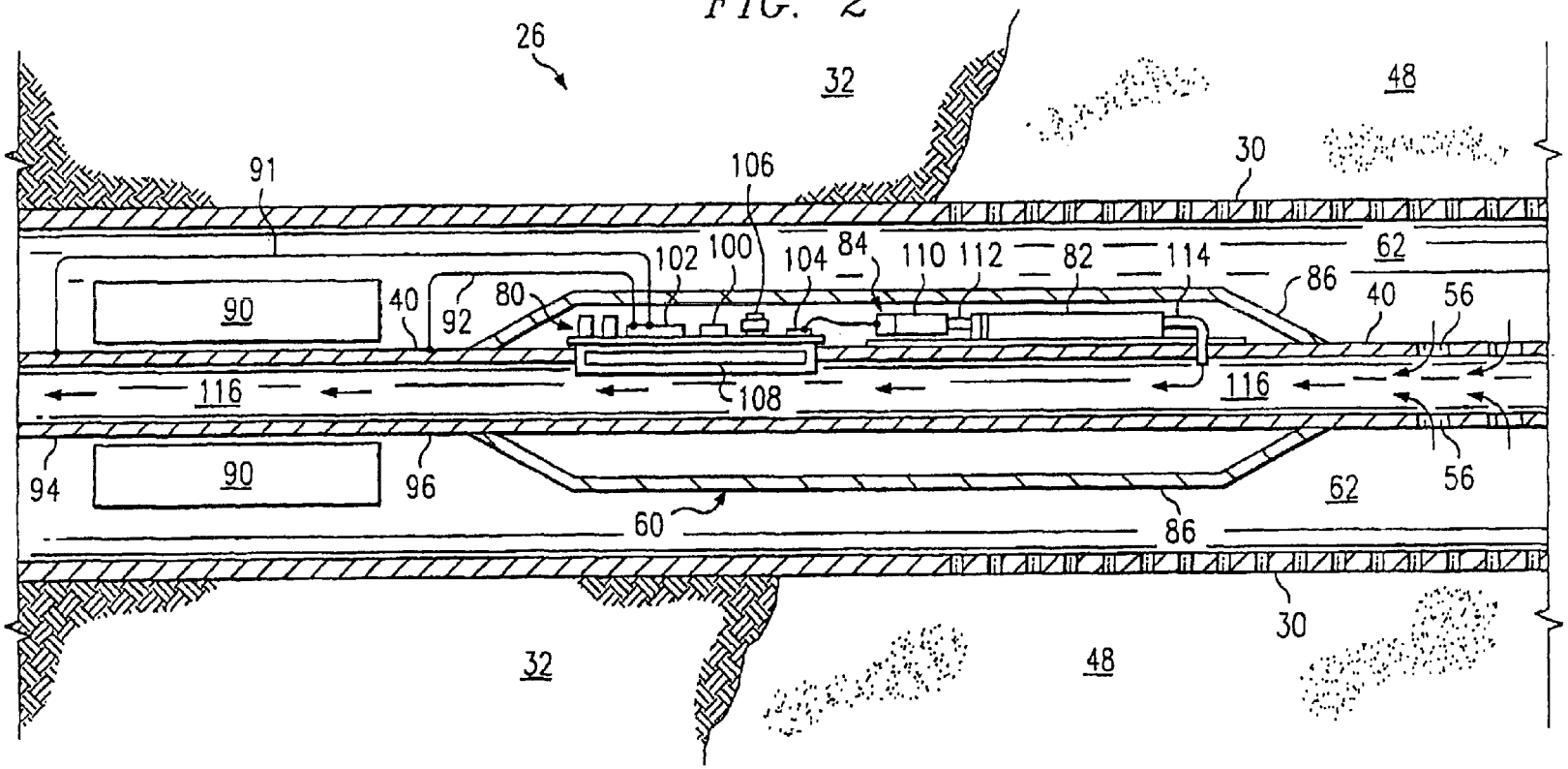
FIG. 2 is an enlarged view of a downhole portion of the well in FIG. 1.

FIG. 2 is an enlarged view showing a portion of the lateral section 26 of FIG. 1 with the electrically controllable downhole chemical injection device 60 therein. The injection device 60 comprises a communications and control module 80, a chemical container 82, and an electrically controllable chemical injector 84. Preferably, the components of an electrically controllable downhole chemical injection device 60 are all contained in a single, sealed tubing pod 86 together as one module for ease of handling and installation, as well as to protect the components from the surrounding environment. However, in other embodiments of the present invention, the components of an electrically controllable downhole chemical injection device 60 can be separate (i.e., no tubing pod 86) or combined in other combinations. A first device terminal 91 of the injection device 60 electrically connects between the tubing 40 on a source-side 94 of the second induction choke 90 and the communications and control module 80. A second device terminal 92 of the injection device 60 electrically connects between the tubing 40 on an electrical-return-side 96 of the second induction choke 90 and the communications and control module 80. Although the lateral packer 54 provides an electrical connection between the tubing 40 on the electrical-return-side 96 of the second induction 90 and the casing 30, the electrical connection between the tubing 40 and the well casing 30 also can be accomplished in numerous ways, some of which can be seen in the Related Applications, including (but not limited to): another packer (conventional or controllable); a conductive centralizer; conductive fluid in the annulus between the tubing and the well casing; or any combination thereof.

Figure 3:
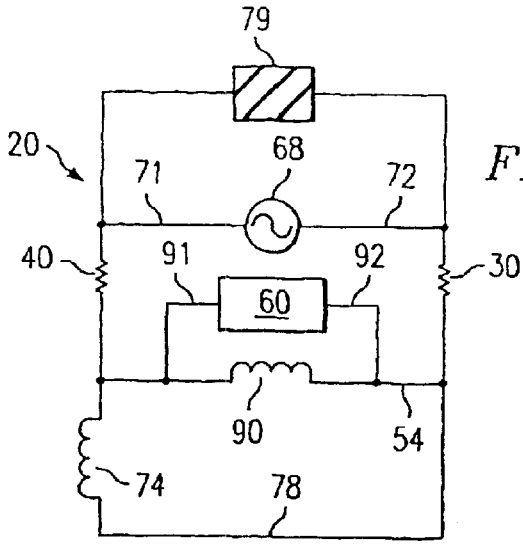
FIG. 3 is a simplified electrical schematic of the electrical circuit formed by the well of FIG. 1.

FIG. 3 is a simplified electrical schematic illustrating the electrical circuit formed in the well 20 of FIG. 1. In operation, power and/or communications are imparted into the tubing 40 at the surface via the first computer terminal 71 below the insulated tubing joint 76. Time-varying current is hindered from flowing from the tubing 40 to the casing 30 via the hanger 88 due to the insulators 79 of the insulated tubing joint 76. However, the time-varying current flows freely along the tubing 40 until the induction chokes 74, 90 are encountered. The first induction choke 74 provides a large inductance that impedes most of the current from flowing through the tubing 40 at the first induction choke. Similarly, the second induction choke 90 provides a large inductance that impedes most of the current from flowing through the tubing 40 at the second induction choke. A voltage potential forms between the tubing 40 and casing 30 due to the induction chokes 74, 90. The voltage potential also forms between the tubing 40 on the source-side 94 of the second induction choke 90 and the tubing 40 on the electrical-return-side 96 of the second induction choke 90. Because the communications and control module 80 is electrically connected across the voltage potential, most of the current imparted into the tubing 40 that is not lost along the way is routed through the communications and control module 80, which distributes and/or decodes the power and/or communications for the injection device 60. After passing through the injection device 60, the current returns to the surface computer system 64 via the lateral packer 54 and the casing 30. When the current is AC, the flow of the current just described will also be reversed through the well 20 along the same path.

Other alternative ways to develop an electrical circuit using a piping structure of a well and at least one induction choke are described in the Related Applications, many of which can be applied in conjunction with the present invention to provide power and/or communications to the electrically powered downhole devices and to form other embodiments of the present invention.

Referring to FIG. 2 again, the communications and control module 80 comprises an individually addressable modem 100, power conditioning circuits 102, a control interface 104, and a sensors interface 106. Sensors 108 within the injection device 60 make measurements, such as flow rate, temperature, pressure, or concentration of tracer materials, and these data are encoded within the communications and control module 80 and transmitted by the modem 100 to the surface computer system 64. Because the modem 100 of the downhole injection device 60 is individually addressable, more than one downhole device may be installed and operated independently of others.

In FIG. 2, the electrically controllable chemical injector 84 is electrically connected to the communications and control module 80, and thus obtains power and/or communications from the surface computer system 64 via the communications and control module 80. The chemical container 82 is in fluid communication with the chemical injector 84. The chemical container 82 is a self-contained chemical reservoir that stores and supplies chemicals for injecting into the flow stream by the chemical injector. The chemical container 82 of FIG. 2 is not supplied by a chemical supply tubing extending from the surface. Hence, the size of the chemical container may vary, depending on the volume of chemicals needed for the injecting into the well. Indeed, the size of the chemical container 82 may be quite large if positioned in the "rat hole" of the well. The chemical injector 84 of a preferred embodiment comprises an electric motor 110, a screw mechanism 112, and a nozzle 114. The electric motor 110 is electrically connected to and receives motion command signals from the communications and control module 80. The nozzle 114 extends into an interior 116 of the tubing 40 and provides a fluid passageway from the chemical container 82 to the tubing interior 116. The screw mechanism 112 is mechanically coupled to the electric motor 110. The screw mechanism 112 is used to drive chemicals out of the container 82 and into the tubing interior 116, via the nozzle 114 in response to a rotational motion of the electric motor 110. Preferably the electric motor 110 is a stepper motor, and thus provides chemical injection in incremental amounts.

In operation, the fluid stream from the production zone 48 passes through the chemical injection device 60 as it flows through the tubing 40 to the surface. Commands from the surface computer system 64 are transmitted downhole and received by the modem 100 of the communications and control module 80. Within the injection device 60 the commands are decoded and passed from the modem 100 to the control interface 104. The control interface 104 then commands the electric motor 110 to operate and inject the specified quantity of chemicals from the container 82 into the fluid flow stream in the tubing 40. Hence, the chemical injection device 60 injects a chemical into the fluid stream flowing within the tubing 40 in response to commands from the surface computer system 64 via the communications and control module 80. In the case of a foaming agent, the foaming agent is injected into the tubing 40 by the chemical injection device 60 as needed to improve the flow and/or lift characteristics of the well 20.

As will be apparent to one of ordinary skill in the art, the mechanical and electrical arrangement and configuration of the components within the electrically controllable chemical injection device 60 can vary while still performing the same function-providing electrically controllable chemical injection downhole. For example, the contents of a communications and control module 80 may be as simple as a wire connector terminal for distributing electrical connections from the tubing 40, or it may be very complex comprising (but not limited to) a modem, a rechargeable battery, a power transformer, a microprocessor, a memory storage device, a data acquisition card, and a motion control card.

Figure 4A:
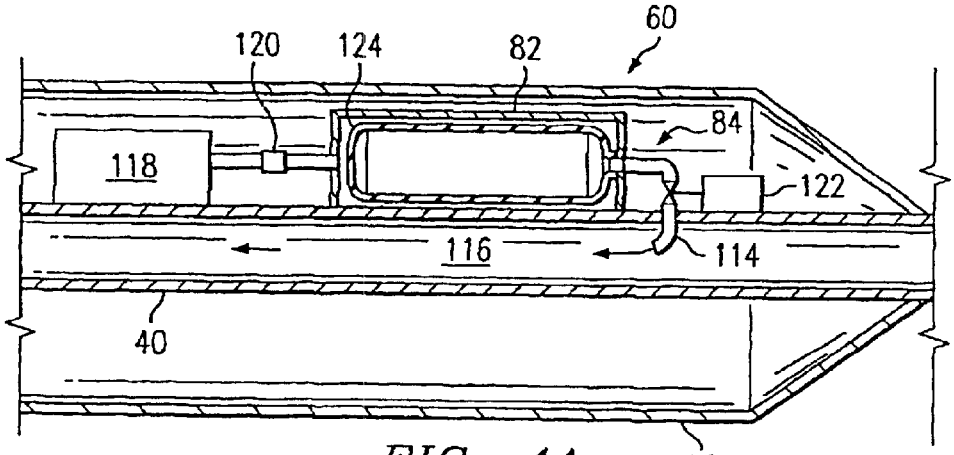
FIGS. 4A–4F are schematics of various chemical injector and chemical container embodiments for a downhole electrically controllable chemical injection device in accordance with the present invention.

FIGS. 4A–4G illustrate some possible variations of the chemical container 82 and chemical injector 84 that may be incorporated into the present invention to form other possible embodiments. In FIG. 4A, the chemical injector 84 comprises a pressurized gas reservoir 118, a pressure regulator 120, an electrically controllable valve 122, and a nozzle 114. The pressurized gas reservoir 118 is fluidly connected to the chemical container 82 via the pressure regulator 120, and thus supplies a generally constant gas pressure to the chemical container. The chemical container 82 has a bladder 124 therein that contains the chemicals. The pressure regulator 120 regulates the passage of pressurized gas supplied from the pressurized gas reservoir 118 into the chemical container 82 but outside of the bladder 124. However, the pressure regulator 120 may be substituted with an electrically controllable valve. The pressurized gas exerts pressure on the bladder 124 and thus on the chemicals therein. The electrically controllable valve 122 regulates and controls the passage of the chemicals through the nozzle 114 and into the tubing interior 116. Because the chemicals inside the bladder 124 are pressurized by the gas from the pressurized gas reservoir 118, the chemicals are forced out of the nozzle 114 when the electrically controllable valve 122 is opened.

Figure 4B:
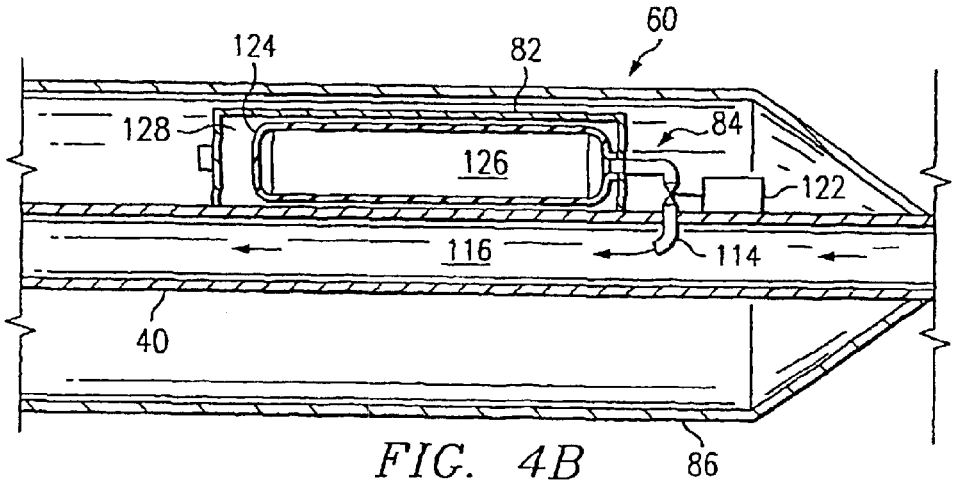

In FIG. 4B, the chemical container 82 is divided into two volumes 126, 128 by a bladder 124, which acts a separator between the two volumes 126, 128. A first volume 126 within the bladder 124 contains the chemical, and a second volume 128 within the chemical container 82 but outside of the bladder contains a pressurized gas. Hence, the container 82 is precharged and the pressurized gas exerts pressure on the chemical within the bladder 124. The chemical injector 84 comprises an electrically controllable valve 122 and a nozzle 114. The electrically controllable valve 122 is electrically connected to and controlled by the communications and control module 80. The electrically controllable valve 122 regulates and controls the passage of the chemicals through the nozzle 114 and into the tubing interior 116. The chemicals are forced out of the nozzle 114 due to the gas pressure when the electrically controllable valve 122 is opened.

Figure 4C:
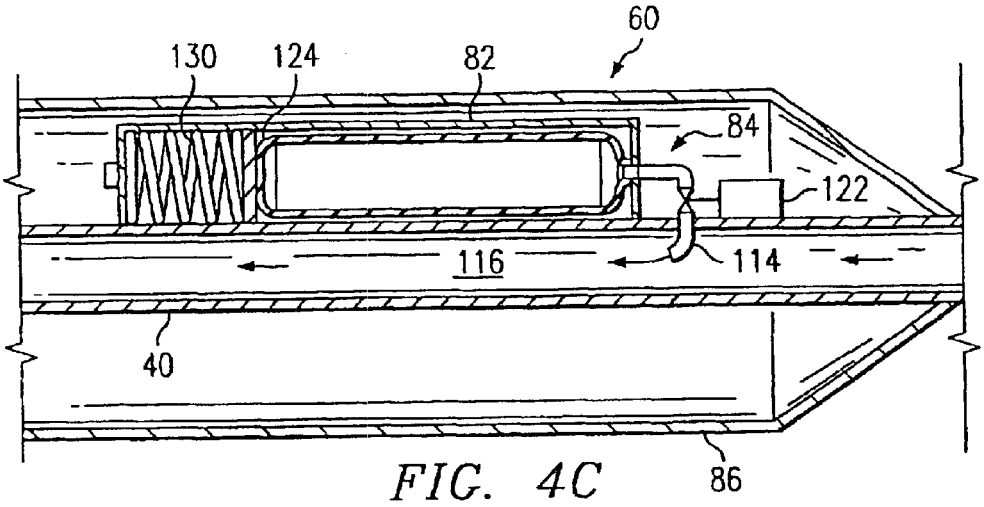

The embodiment shown in FIG. 4C is similar that of FIG. 4B, but the pressure on the bladder 124 is provided by a spring member 130. Also in FIG. 4C, the bladder may not be needed if there is movable seal (e.g., sealed piston) between the spring member 130 and the chemical within the chemical container 82. One of ordinary skill in the art will see that there can be many variations on the mechanical design of the chemical injector 84 and on the use of a spring member to provide pressure on the chemical.

Figure 4D:
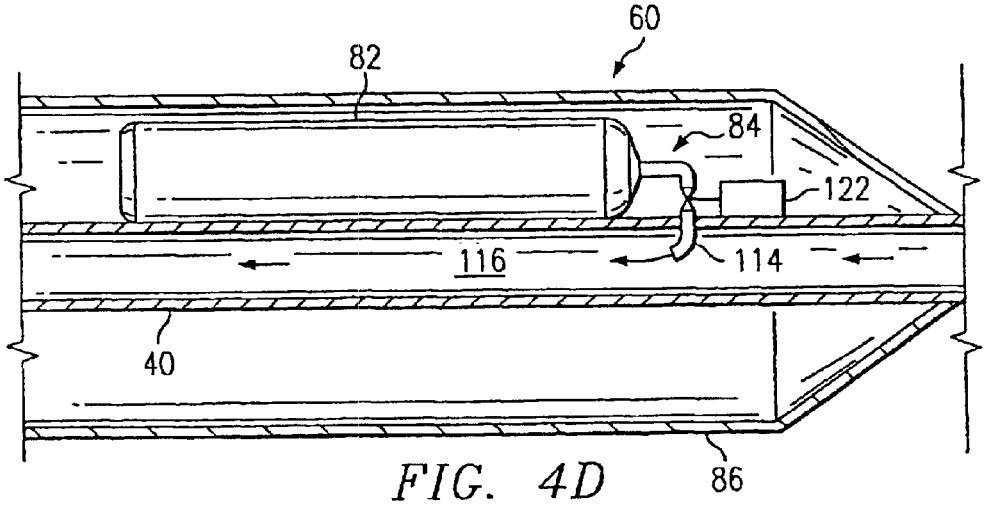

In FIG. 4D, the chemical container 82 is a pressurized bottle containing a chemical that is a pressurized fluid. The chemical injector 84 comprises an electrically controllable valve 122 and a nozzle 114. The electrically controllable valve 122 regulates and controls the passage of the chemicals through the nozzle 114 and into the tubing interior 116. Because the chemicals inside the bottle 82 are pressurized, the chemicals are forced out of the nozzle 114 when the electrically controllable valve 122 is opened.

Figure 4E:
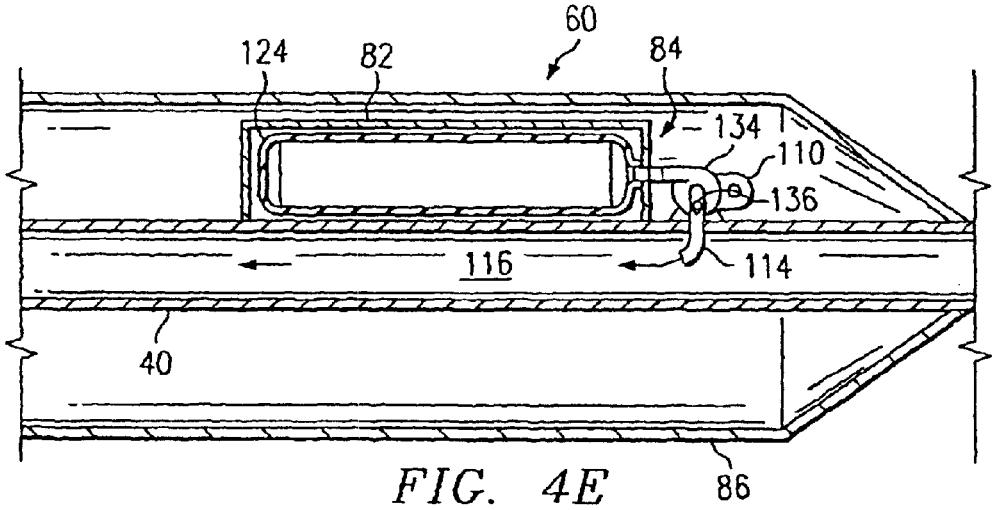

In FIG. 4E, the chemical container 82 has a bladder 124 containing a chemical. The chemical injector 84 comprises a pump 134, a one-way valve 136, a nozzle 114, and an electric motor 110. The pump 134 is driven by the electric motor 110, which is electrically connected to and controlled by the communications and control module 80. The one-way valve 136 prevents backflow into the pump 134 and bladder 124. The pump 134 drives chemicals out of the bladder 124, through the one-way valve 136, out of the nozzle 114, and into the tubing interior 116. Hence, the use of the chemical injector 84 of FIG. 4E may be advantageous in a case where the chemical reservoir or container 82 is arbitrarily shaped to maximize the volume of chemicals held therein for a given configuration because the chemical container configuration is not dependent on chemical injector 84 configuration implemented.

Figure 4F:
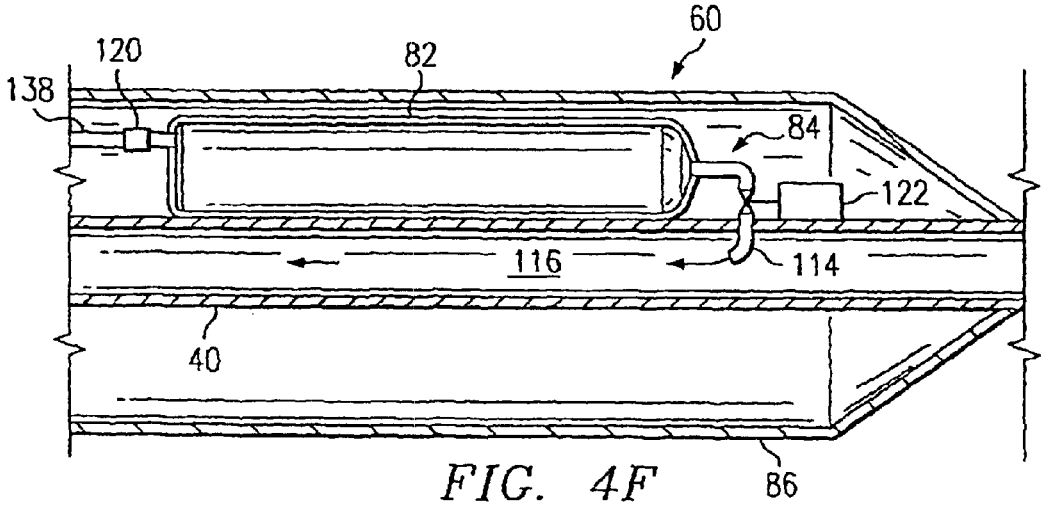

FIG. 4F shows an embodiment of the present invention where a chemical supply tubing 138 is routed downhole to the chemical injection device 60 from the surface. Such an embodiment may be used in a case where there is a need to inject larger quantities of chemicals into the tubing interior 116. The chemical container 82 of FIG. 4F provides both a fluid passageway connecting the chemical supply tubing 138 to the chemical injector 84, and a chemical reservoir for storing some chemicals downhole. Also, the downhole container 82 may be only a fluid passageway or connector (no reservoir volume) between the chemical supply tubing 138 and the chemical injector 84 to convey bulk injection material from the surface as needed.

Thus, as the examples in FIGS. 4A–4F illustrate, there are many possible variations for the chemical container 82 and chemical injector 84. One of ordinary skill in the art will see that there can be many more variations for performing the functions of supplying, storing, and/or containing a chemical downhole in combination with controllably injecting the chemical into the tubing interior 116 in response to an electrical signal. Variations (not shown) on the chemical injector 84 may further include (but are not limited to): a venturi tube at the nozzle; pressure on the bladder provided by a turbo device that extracts rotational energy from the fluid flow within the tubing; extracting pressure from other regions of the formation routed via a tubing; any possible combination of the parts of FIGS. 4A–4F; or any combination thereof.

Also, the chemical injection device 60 may not inject chemicals into the tubing interior 116. In other words, a chemical injection device may be adapted to controllably inject a chemical into the formation 32, into the casing 30, or directly into the production zone 48. Also, a tubing extension (not shown) may extend from the chemical injector nozzle to a region remote from the chemical injection device (e.g., further downhole, or deep into a production zone).

The chemical injection device 60 may further comprise other components to form other possible embodiments of the present invention, including (but not limited to): a sensor, a modem, a microprocessor, a logic circuit, an electrically controllable tubing valve, multiple chemical reservoirs (which may contain different chemicals), or any combination thereof. The chemical injected may be a solid, liquid, gas, or mixtures thereof. The chemical injected may be a single component, multiple components, or a complex formulation. Furthermore, there can be multiple controllable chemical injection devices for one or more lateral sections, each of which may be independently addressable, addressable in groups, or uniformly addressable from the surface computer system 64. In alternative to being controlled by the surface computer system 64, the downhole electrically controllable injection device 60 can be controlled by electronics therein or by another downhole device. Likewise, the downhole electrically controllable injection device 60 may control and/or communicate with other downhole devices. In an enhanced form of an electrically controllable chemical injection device 60, it comprises one or more sensors 108, each adapted to measure a physical quality such as (but not limited to): absolute pressure, differential pressure, fluid density, fluid viscosity, acoustic transmission or reflection properties, temperature, or chemical make-up.

Upon review of the Related Applications, one of ordinary skill in the art will also see that there can be other electrically controllable downhole devices, as well as numerous induction chokes, further included in a well to form other possible embodiments of the present invention. Such other electrically controllable downhole devices include (but are not limited to): one or more controllable packers having electrically controllable packer valves, one or more electrically controllable gas-lift valves; one or more modems, one or more sensors; a microprocessor; a logic circuit; one or more electrically controllable tubing valves to control flow from various lateral branches; and other electronic components as needed.

The present invention also may be applied to other types of wells (other than petroleum wells), such as a water production well.

It will be appreciated by those skilled in the art having the benefit of this disclosure that this invention provides a petroleum production well having at least one electrically controllable chemical injection device, as well as methods of utilizing such devices to monitor and/or improve the well production. It should be understood that the drawings and detailed description herein are to be regarded in an illustrative rather than a restrictive manner, and are not intended to limit the invention to the particular forms and examples disclosed. On the contrary, the invention includes any further modifications, changes, rearrangements, substitutions, alternatives, design choices, and embodiments apparent to those of ordinary skill in the art, without departing from the spirit and scope of this invention, as defined by the following claims. Thus, it is intended that the following claims be interpreted to embrace all such further modifications, changes, rearrangements, substitutions, alternatives, design choices, and embodiments.

The invention claimed is:

1. A chemical injection system for use in a well, comprising:

a current impedance device being generally configured for positioning about a portion of a piping structure of said well for supplying a time-varying electrical signal transmitted through and along said piping structure; and an electrically controllable chemical injection device adapted to be electrically connected to said piping structure, adapted to be powered by an electrical signal, and adapted to expel a chemical in response to an electrical signal.

2. A chemical injection system in accordance with claim 1, wherein said piping structure comprises at least a portion of a production tubing of said well.

3. A chemical injection system in accordance with claim 1, wherein said piping structure comprises at least a portion of a well casing.

4. A chemical injection system in accordance with claim 1, wherein said injection device comprises an electric motor and a communications and control module, said electrical motor being electrically connected to and adapted to be controlled by said communications and control module.

5. A chemical injection system in accordance with claim 1, wherein said injection device comprises an electrically controllable valve and a communications and control module, said electrically controllable valve being electrically connected to and adapted to be controlled by said communications and control module.

6. A chemical injection system in accordance with claim 1, wherein said injection device comprises a chemical reservoir and a chemical injector, said chemical reservoir being in fluid communication with said chemical injector, and said chemical injector being adapted to expel from said injection device chemicals from within said chemical reservoir in response to said electrical signal.

7. A chemical injection system in accordance with claim 1, wherein said electrical signal is a power signal.

8. A chemical injection system in accordance with claim 1, wherein said electrical signal is a communication signal.

9. A chemical injection system in accordance with claim 1, wherein said electrical signal is a control signal from a surface computer system.

10. A petroleum well for producing petroleum products, comprising:

a piping structure positioned within the borehole of the well;

a source of time-varying current electrically connected to said piping structure;

an induction choke located about a portion of said piping structure;

an electrically controllable chemical injection device coupled to said piping structure downhole in the borehole for receiving power and communication signals via said time-varying current and configured for injecting chemicals.

11. A petroleum well in accordance with claim 10, wherein said induction choke is unpowered and comprises a ferromagnetic material, such that said induction choke functions based on its size, geometry, spatial relationship to said piping structure, and magnetic properties.

12. A petroleum well in accordance with claim 10, wherein said piping structure comprises at least a portion of a production tubing, and an electrical return comprises at least a portion of a well casing.

13. A petroleum well in accordance with claim 10, wherein said piping structure comprises at least a portion of a well casing.

14. A petroleum well in accordance with claim 10, wherein said chemical injection device comprises an electrically controllable valve.

15. A petroleum well in accordance with claim 10, wherein said chemical injection device comprises an electric motor.

16. A petroleum well in accordance with claim 10, wherein said chemical injection device comprises a modem.

17. A petroleum well in accordance with claim 10, wherein said chemical injection device comprises a chemical reservoir.

18. A petroleum well in accordance with claim 17, wherein said chemical reservoir is positioned for injecting chemicals into the piping structure.

19. A petroleum well in accordance with claim 10, wherein said chemical injection device comprises a sensor.

20. A petroleum well for producing petroleum products comprising:

a well casing extending within a wellbore of said well;

a production tubing extending within said casing;

a source of time-varying signals located at the surface, said signal source being electrically connected to, and adapted to output a time-varying signal into, at least one of said tubing and said casing; and a downhole chemical injection device comprising a communications and control module, a chemical container, and an electrically controllable chemical injector, said communications and control module being electrically connected to at least one of said tubing and said casing for receiving time-varying signals therefrom, said chemical injector being electrically connected to said communications and control module, and said chemical container being in fluid communication with said chemical injector.

21. A petroleum well in accordance with claim 20, wherein said chemical injector comprises an electric motor, a screw mechanism, and a nozzle, said electric motor being electrically connected to said communications and control module, said screw mechanism being mechanically coupled to said electric motor, said nozzle extending into an interior of said tubing, said nozzle providing a fluid passageway between said chemical container and said tubing interior, and screw mechanism being adapted to drive fluid out of said chemical container and into said tubing interior via said nozzle in response to a rotational motion of said electric motor.

22. A petroleum well in accordance with claim 20, wherein said chemical injector comprises a gas container filled with a pressurized gas, a pressure regulator, an electrically controllable valve, and a nozzle, and wherein an interior of said chemical container comprises a separator forming a first volume for containing a chemical and second volume, said gas container being in fluidly communication with said second chemical container interior volume via said pressure regulator such that pressurized gas can be in said second volume and outside of said first volume to exert pressure on said chemical in said first volume, said electrically controllable valve being electrically connected to said communications and control module for receiving power and control command signals therefrom, and said electrically controllable valve being adapted to regulate and control a passage of said chemicals from said first volume through said nozzle and into a tubing interior.

23. A petroleum well in accordance with claim 20, wherein said chemical container comprises a separator therein that divides an interior of said chemical container into two volumes, and wherein said chemical injector comprises an electrically controllable valve and a nozzle, a first of said chemical container interior volumes containing a chemical, a second of said chemical container interior volumes containing a pressurized gas such that said gas exerts pressure on said chemical in said first volume, said electrically controllable valve being electrically connected to and controlled by said communications and control module, and said first volume being fluidly connected to an interior of said tubing via said electrically controllable valve and via said nozzle.

24. A petroleum well in accordance with claim 20, wherein said chemical container comprises a separator therein that divides an interior of said chemical container into two volumes, and wherein said chemical injector comprises an electrically controllable valve and a nozzle, a first of said chemical container interior volumes containing a chemical, a second of said chemical container interior volumes containing a spring member such that said spring member exerts a force on said chemical in said first volume, said electrically controllable valve being electrically connected to and controlled by said communications and control module, and said first volume being fluidly connected to an interior of said tubing via said electrically controllable valve and via said nozzle.

25. A petroleum well in accordance with claim 20, wherein said chemical container is adapted to hold a pressurized chemical therein, and wherein said chemical injector comprises an electrically controllable valve and a nozzle, said electrically controllable valve being electrically connected to and controlled by said communications and control module, said nozzle extending into an interior of said tubing, said chemical container being fluidly connected to said tubing interior via said electrically controllable valve and via said nozzle.

26. A petroleum well in accordance with claim 20, wherein said chemical injector comprises an electric motor, a pump, a one-way valve, and a nozzle, said electric motor being electrically connected to and controlled by said communications and control module, said pump being mechanically coupled to said electric motor, said nozzle extending into an interior of said tubing, said chemical container being fluidly connected to said tubing interior via said pump, via said one-way valve, and via said nozzle.

27. A petroleum well in accordance with claim 20, further comprising a chemical supply tubing extending from the surface to the downhole chemical injection device, wherein said chemical container comprises a fluid passageway fluidly connecting said chemical supply tubing to an interior of said tubing via said chemical injector.

28. A petroleum well in accordance with claim 27, wherein said chemical container further comprises a chemical reservoir portion.

29. A petroleum well in accordance with claim 20, wherein said chemical container comprises a self-contained downhole fluid reservoir adapted to supply a chemical for said downhole chemical injection device.

30. A petroleum well in accordance with claim 20, including an unpowered induction choke comprising a ferromagnetic material.

31. A petroleum well in accordance with claim 20, the chemical container being configured for dispersing chemicals into at least one of the tubing or casing.

32. A petroleum well in accordance with claim 20, the chemical container being configured for dispersing chemicals into the formation external to the casing.

33. A petroleum well in accordance with claim 20, wherein said downhole injection device further comprises a sensor, said sensor being electrically connected to said communications and control module.

34. A petroleum well in accordance with claim 20, wherein said communications and control module comprises a modem.

35. A method of operating a petroleum well, comprising the steps of:

providing a piping structure;

providing a downhole chemical injection system for said well connected downhole to said piping structure, transmitting an AC signal on the piping structure to power and communicate with the downhole chemical injection system; and controllably injecting a chemical in response to an AC signal during operation.

36. A method in accordance with claim 35, wherein said well is a gas-lift well and said chemical comprises a foaming agent, and further comprising the step of improving an efficiency of artificial lift of said petroleum productions with said foaming agent.

37. A method in accordance with claim 35, wherein said chemical comprises a paraffin solvent and the piping structure includes tubing, and further comprising the step of hindering a deposition of solids on an interior of said tubing.

38. A method in accordance with claim 35, wherein said chemical comprises a surfactant, and further comprising the step of improving a flow characteristic of said flow stream.

39. A method in accordance with claim 35, wherein said chemical comprises a corrosion inhibitor, and further comprising the step of inhibiting corrosion in said well.

40. A method in accordance with claim 35, wherein said chemical comprises scale preventers, and further comprising the step of reducing scaling in said well.

41. A method in accordance with claim 35, wherein said chemical comprises fracturing compound, and further comprising the step of injecting said fracturing compound into the formation around said well.

* * * * *